United States Patent [19]

Wukovich

[11] 4,141,406

[45] Feb. 27, 1979

[54] BREAKER CORES

[75] Inventor: Nick Wukovich, North Olmsted, Ohio

[73] Assignee: Foseco Trading AG., Chur, Switzerland

[21] Appl. No.: 823,369

[22] Filed: Aug. 10, 1977

[30] Foreign Application Priority Data

Mar. 1, 1977 [GB] United Kingdom ..... 8580/77
Apr. 29, 1977 [GB] United Kingdom ..... 18048/77

[51] Int. Cl.[2] ..... B22C 9/08
[52] U.S. Cl. ..... 164/359; 249/197
[58] Field of Search ..... 164/120, 122, 163, 244, 164/359, 360, 242, 241, 45, 264, 70; 249/197, 105

[56] References Cited

U.S. PATENT DOCUMENTS

| | | | |
|---|---|---|---|
| 969,015 | 8/1910 | Washburn | 164/359 |
| 1,049,877 | 1/1913 | Lange | 164/359 X |
| 2,198,498 | 4/1940 | Hagemeyer | 164/359 X |
| 2,334,701 | 11/1943 | Galvin et al. | 164/360 |
| 2,335,008 | 11/1943 | Hites | 164/360 |
| 3,815,665 | 6/1974 | Baur | 164/359 |

FOREIGN PATENT DOCUMENTS

| | | | |
|---|---|---|---|
| 2109780 | 9/1972 | Fed. Rep. of Germany | 164/359 |

*Primary Examiner*—Richard B. Lazarus
*Assistant Examiner*—John S. Brown
*Attorney, Agent, or Firm*—Caesar, Rivise, Bernstein & Cohen, Ltd.

[57] ABSTRACT

A breaker core for use in metal casting is described. The core is located in a casting mould between a riser and the cavity corresponding to the casting. The core consists of a base having an aperture (which defines a neck between the casting and the solidified metal in the riser) and means for frictional engagement with a casting riser lining sleeve or with a casting riser cavity. The base may have a recess which receives a projection extending from the sleeve or an upstanding lip at or somewhat spaced from the edge of the base for engagement with an inner or an outer wall of the riser sleeve.

15 Claims, 8 Drawing Figures

Fig. 3
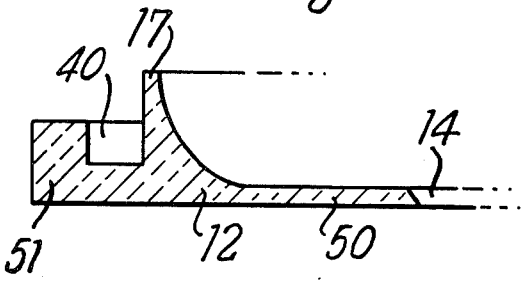
Fig. 4
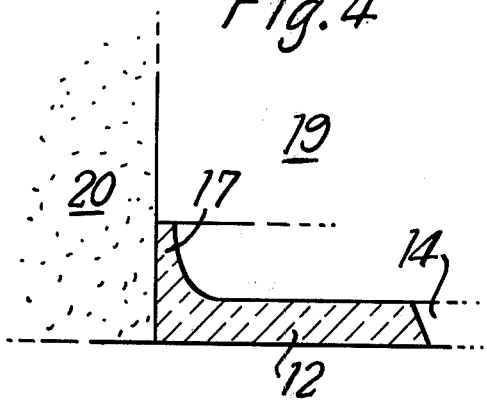
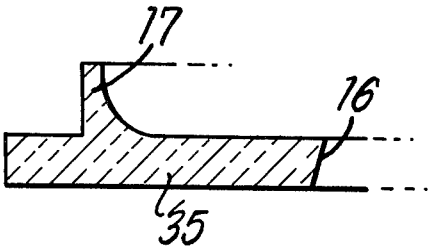
Fig. 5
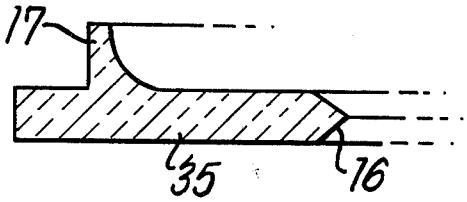
Fig. 6
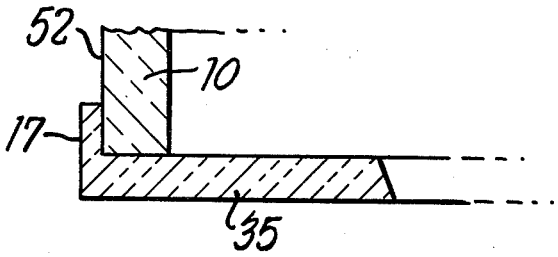
Fig. 7
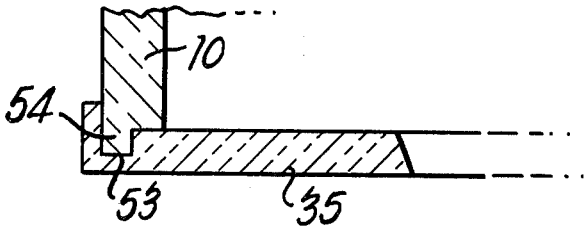
Fig. 8

BREAKER CORES

This invention relates to a breaker core for use in the casting of molten metals.

It is known in foundry practice to superimpose on a casting cavity a reservoir of molten metal known as a metal head, feeding head, sink head or riser. Some of the molten metal in the riser flows into the mould cavity below to compensate for shrinkages in the casting body which occur on cooling and solidification. In older foundry practice, the riser was not insulated, but in recent years the riser has been lined with a sleeve of heat insulating material or a sleeve of an exothermic material or a combination of the two. In order to prevent the escape of heat from the upper surface of the riser, a top cover or anti-piping compound is usually placed on the surface of the molten metal in the riser.

Where the riser sleeve is of insulating material, exothermic material or a combination of the two, the riser is of a smaller volume than when the riser is uninsulated. This is because an uninsulated riser must necessarily contain a greater quantity of hot metal to provide sufficient heat to maintain the metal in the riser liquid for a period of time exceeding the time of complete solidification of the casting. In the case of heat generating or heat insulating riser sleeves or sleeves which are both heat generating and heat insulating, the volume can be smaller since the heat generated within the sleeve and/or the thermal insulation furnished by the sleeve serves to minimise or substantially eliminate the heat loss.

When a casting having a riser has solidified and is removed from the mould the riser remains attached to the casting and must be removed. Removal of the riser is not only costly in terms of labour but damage to the casting can result.

In order to faciliate the removal of the riser, it is frequently the practice to locate a breaker core at the base of the riser cavity. This technique is described in U.S. Pat. No. 900,970 and nowadays is usually done by securing the breaker core to the mould or by moulding a performed core into the mould. The breaker core is essentially a disc having an aperture. The breaker core functions to permit the flow of liquid metal as needed to compensate for metal shrinkage into the mould cavity, and also has the effect of reducing the contact area of the riser with the casting after solidification. The use of the breaker core in effect enables the achievement of a narrowed neck which constitutes a section of reduced cross-section joining the metal of the riser to the body of the casting. This facilitates the removal of the riser which is effected by a cutting or knocking off operation. Even after the removal of the riser, it is still generally necessary to clean or smooth the area exposed following removal of the riser but the area which requires cleaning is much smaller than would be the case if no breaker core were used.

When the riser cavity is lined with a sleeve of exothermic and/or best insulating material the breaker core may be moulded as described above, or may be secured to the lower end of the sleeve by means of an adhesive, either as such or as part of an adhesive tape. However, these means have disadvantages. Adhesives need to be dried or chemically hardened in order to secure a bond, and in practice a bond of the desired strength is not always achieved. The sleeve and core tend to separate during manufacture, handling, transport or storage. In addition, adhesives can give rise to the evolution of gases when affected by the heat of the molten metal entering the mould and even if the adhesive is still effective at that stage, the heat sometimes melts the adhesive and causes the breaker core to drop off.

Known breaker cores have further disadvantages in that they are difficult to locate centrally on the lower end of the riser sleeve, and also molten metal can penetrate between the upper surface of the breaker core and the lower end of the sleeve producing "fins". These fins reduce the efficiency of the riser, introduce a tendency for cracks to be produced in the casting, increase the amount of cleaning of the casting needed and waste metal.

It has now been found that the breaker core may simply and easily be secured to the riser sleeve if the breaker core is provided with means for frictional engagement of the breaker core with the riser sleeve.

According to the present invention there is provided a casting mould breaker core which comprises a base having an aperture therein and means for frictional engagement with a casting riser lining sleeve or with a casting riser cavity.

The means may comprise a recess in the base of the breaker core for receiving a projection extending from the bottom of the casting riser lining sleeve, but preferably the means comprises on the base of the breaker core an upstanding lip for frictional engagement with a casting riser lining sleeve or with a casting riser cavity. The upstanding lip may be at or somewhat spaced from the outer edge of the base, and the lip may engage with an inner or an outer wall of the sleeve.

The breaker core base may have both a recess and an upstanding lip if desired.

In the most preferred form the base of the breaker core has an upstanding lip spaced from the outer edge of the base and the lip engages with the inner wall of the sleeve.

In use the outer surface of the lip is wedged against the inner surface of the wall of the sleeve to achieve a tight fit. The lower end of the riser sleeve wall may rest on the base between the lip and the outer edge of the base. The inner surface of the lip may be perpendicular to the base but preferably the inner surface of the lip merges downwardly in a gentle arc to the upper surface of the base terminating at the wall which defines the aperture in the base.

The outer surface of the lip is preferably slightly tapered to improve the tolerance of size variations between individual cores and individual riser sleeves.

The taper on the outer surface of the lip will generally be in the range of 1 in 6 to 1 in 10, the end of the lip first inserted into the riser sleeve being of lesser diameter than the lip end adjacent the base.

The base of the breaker core, the transverse cross section of the riser sleeve, and the breaker core aperture will usually be circular but they may be oval, square, rectangular or some other shape.

While the lower surface of the breaker core will usually be flat this surface may be arcuate or curved in order to conform to the surface of the mould cavity.

The breaker core of the invention may be made from materials known for use in the manufacture of breaker cores, for example particulate refractory material such as silica sand, chromite sand or zircon sand, bonded with a resin such as phenol-formaldehyde resin, a core-oil such as linseed oil, a carbohydrate binder such as starch or sodium silicate. Particulate refractory materials other than sand may also be used. The breaker core may also be made from fibres or contain fibres such as aluminosilicate fibres or calcium silicate fibres in addition to particulate refractory material.

The invention is illustrated with reference to the accompanying drawings in which:

FIG. 3 is a sectional view of part of a further form of breaker core;

FIG. 4 is a sectional view of part of a further type of breaker core set in a sand mould, and FIGS. 5, 6, 7 and 8 are sectional views of parts of further form of breaker core.

Figure 1:
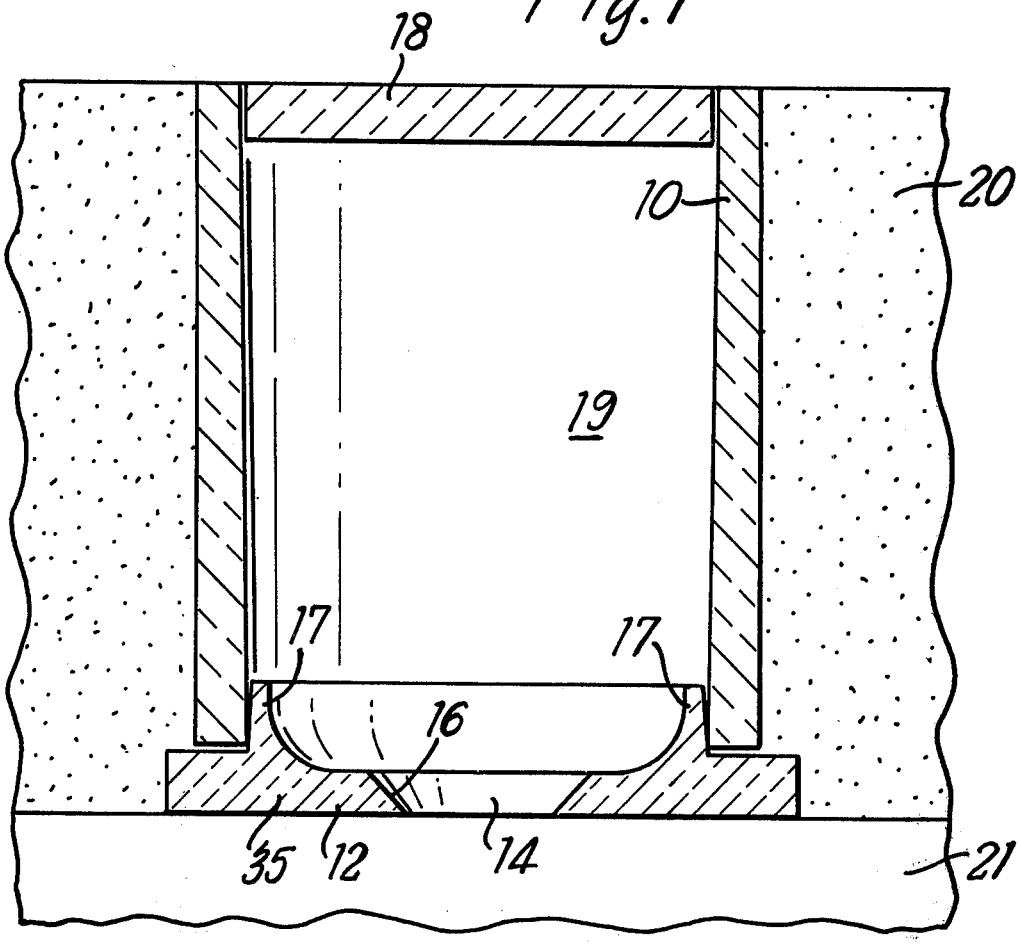
FIG. 1 is a sectional view of a casting mould showing a breaker core of the invention located above a mould cavity and secured in a riser sleeve.

In the embodiment of FIG. 1 a riser sleeve 10 formed either of an insulating material or of an exothermic material or a combination of the two, and having an overall internal taper of 1 in 48, is located over a mould cavity 21 and backed by moulding sand 20. A breaker core 12 in bonded silica sand has an opening 14. The core 12 is secured to the lower end of the sleeve 10 by wedging a lip 17 upstanding from the breaker core within, into the lower end of the sleeve. It is not necessary to use adhesives but if desired a spot or two of adhesive may be located in the joint, for added safety. The lower end of the sleeve 10, particularly the inner wall of the sleeve, may deform slightly when the breaker core is inserted.

Figure 2:
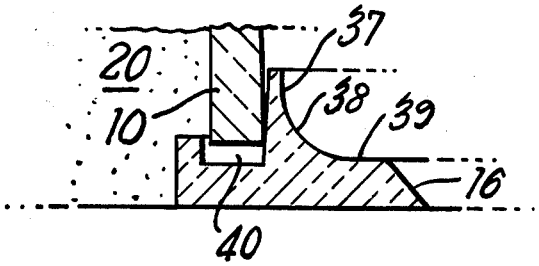
FIG. 2 is a sectional view showing the detail of a portion of another form of the breaker core shown in FIG. 1.

The details of a breaker core of this invention are seen in FIGS. 1 and 2. The core has an upstanding lip 17 extending upwardly from a base 35. As shown in FIG. 1 the lip 17 is of a height approximately the same as the thickness of the base 35 of the breaker core 12, and has an external taper of 1 in 8.3.

Since the breaker core 12 is generally of circular shape the lip 17 takes the form of a circular ridge whose outer diameter at a level intermediate the base and top of the lip is essentially the same as the inner diameter of riser sleeve 10, thereby making for a snug fit. The outer tapered surface of the lip 17 is tightly wedged into the inner substantially cylindrical wall of the riser sleeve 10.

In some instances there is a problem known as "springback" when certain types of insulating riser sleeves are moulded using a high pressure moulding machine one example of which is known as "Taccone".

In such a situation the riser sleeve is liable to be compressed lengthwise during the moulding operation, such that when the moulding pressure is removed, the sleeve expands lengthwise elastically with the result that it either extends beyond the top of the mould or even expands perhaps an eighth of an inch into the mould cavity. Such a "springback" can be accommodated by providing a circular groove 40 in the base of the breaker core, so that the assembly of riser sleeve and breaker core can be of the correct total length and the breaker core can be set into the sleeve and the mould without protrusion. This type of breaker core is shown in FIG. 2. In such a breaker core, an internal surface 37 extends from the internal surface of the lip 17 in a gentle arc 38 and finally becomes the base 39 of the breaker core 12, whence it meets wall 16 defining aperture 14 in the breaker core 12.

In use of breaker core types as shown in FIG. 1 the mould cavity 21 and riser sleeve 10 were filled with molten metal. A preformed top cover 18 of a refractory heat insulating material was then applied, although a powdered exothermic material can be applied instead of the preformed cover to reduce heat loss from the metal in the riser. After solidication, the head remaining within the sleeve was knocked off cleanly and quickly.

The wall 16 defining the aperture of the breaker core may taper inwardly from the top so that the smallest diameter of the aperture is at the lower surface of the base as in FIG. 1, or both inwardly from the top and inwardly from the bottom so that the smallest diameter of the aperture is approximately half-way through the thickness of the base as in FIG. 6, or inwardly from the bottom so that the smallest diameter of the aperture is at the upper surface of the base as in FIG. 5.

In a further modification of the breaker core and as shown in FIG. 3, the base within the lip at 50 is relatively thinner and that outside the lip at 51 thicker. Thinning the base decreases the initial chilling effect created by the presence of the core and allows satisfactory molten metal feed to be achieved with a smaller aperture 14; it is naturally desirable to make aperture 14 as small as possible to facilitate removal of the solidified riser. The thickening of the base outside the lip at 51 compensates for the decrease in strength of the core which would otherwise result from thinning the base inside the lip at 50.

In a further modification of the breaker core and as shown in FIG. 7 the lip 17 is at the outer edge of the base 35 and the lip 17 engages with the outer wall 52 of the riser sleeve 10.

In yet a further modification of the breaker core and as shown in FIG. 8 the base 35 of the breaker core has a recess 53 for receiving a projection 54 extending from the bottom of the riser sleeve 10.

The breaker core of the invention is particularly suited for use in conjunction with blind or domed riser sleeves which are so-named because they are closed at their upper end by an integral top cover which is usually domed in shape.

The embodiments of the invention, in which an exclusive privilege or property is claimed, are defined as follows:

1. In a metal casting mold including a cavity and a riser having a lining sleeve therein, an improved breaker core, said core comprising a base having an aperture therein and a lip projecting up from said base, said lip comprising a tapered surface frictionally engaging in a wedging action a peripheral surface of said sleeve to securely hold said core in place in said sleeve to form an integral unit.

2. The breaker core of claim 1 wherein said lining sleeve includes a lower end in the form of a projection and wherein said breaker core additionally comprises a recess in the base disposed immediately adjacent to said lip for receiving the projection of the casting riser lining sleeve.

3. The breaker core of claim 1 wherein the lip is upstanding and is spaced from the outer edge of the base.

4. The breaker core of claim 3 wherein the lip includes an outer surface, said core additionally comprising a groove in the base intermediate the outer surface of the lip and the outer edge of the base.

5. The breaker core of claim 3 wherein the base outside the lip is thicker than the base inside the lip.

6. The breaker core of claim 1 wherein the upstanding lip is at the outer edge of the base.

7. The breaker core of claim 1 wherein the inner surface of the lip extends downwardly, in a gentle arc in section, to the upper surface of the base, and terminates at a wall defining the aperture in the base.

8. The breaker core of claim 1 wherein the outer surface of the lip is inwardly tapered away from the base.

9. The breaker core of claim 8 wherein the taper is within the range 1 in 6 to 1 in 10.

10. The breaker core of claim 1 wherein the aperture, base and lip are circular.

11. The breaker core of claim 1 wherein the base is flat.

12. The breaker core of claim 1 wherein the base is arcuate.

13. The breaker core of claim 1 formed of bonded particulate refractory material.

14. The breaker core of claim 1 formed of bonded inorganic refractory fibre.

15. The breaker core of claim 1 formed of a bonded mixture of inorganic refractory fibre and particulate refractory material.

* * * * *